US005256094A

United States Patent [19]

Canna

[11] Patent Number: 5,256,094

[45] Date of Patent: Oct. 26, 1993

[54] BUOYANCY COMPENSATOR FOR DIVERS

[75] Inventor: John S. Canna, Lockport, N.Y.

[73] Assignee: The Sherwood Group, Lockport, N.Y.

[21] Appl. No.: 689,144

[22] Filed: Apr. 22, 1991

[51] Int. Cl.[5] ..... B63C 11/08

[52] U.S. Cl. ..... 441/96; 405/186

[58] Field of Search ..... 441/96; 405/186

[56] References Cited

U.S. PATENT DOCUMENTS

| | | | |
|---|---|---|---|
| 3,487,647 | 1/1970 | Brecht, Jr. et al. | 61/69 |
| 3,727,250 | 4/1973 | Koehn et al. | 9/313 |
| 4,000,534 | 1/1977 | Cerniway et al. | 405/186 |
| 4,054,132 | 10/1977 | Deeds | 441/96 |
| 4,068,657 | 1/1978 | Kobzan | 128/142 |
| 4,114,389 | 9/1978 | Bohmrich et al. | 441/96 |
| 4,437,790 | 3/1984 | Trop | 405/186 |
| 4,523,914 | 6/1985 | Faulconer et al. | 441/108 |
| 4,529,333 | 7/1985 | Robinette | 405/186 |
| 4,681,552 | 7/1987 | Courtney | 441/92 |
| 4,720,281 | 1/1988 | Matsuoka | 405/186 |
| 4,779,554 | 10/1988 | Courtney | 114/315 |
| 4,810,134 | 3/1989 | Eaulconer et al. | 405/186 |
| 4,913,589 | 4/1990 | Faulconer et al. | 405/186 |
| 4,986,700 | 1/1991 | Takeda | 405/186 |

FOREIGN PATENT DOCUMENTS

| | | | |
|---|---|---|---|
| 218996 | 9/1989 | Japan | 405/186 |

OTHER PUBLICATIONS

Sherwood Freedom Brand Buoyancy Compensator Sales Brochure.

*Primary Examiner*—Michael S. Huppert
*Assistant Examiner*—Thomas J. Brahan
*Attorney, Agent, or Firm*—Michael L. Dunn

[57] ABSTRACT

An improved buoyancy compensator for providing buoyancy to a Scuba diver. The compensator comprises a vest including a compartment for holding a gas, which compartment is connected by means of an inflation tube, through a control valve and a regulating valve, to a gas supply, so that opening of the control valve allows gas to flow from the gas supply through the tube into the compartment. The compensator is further provided with a gas release valve which allows gas to leave the compartment to a surrounding environment. The compensator is provided with a trigger activated, remote control to open and close the gas release valve.

3 Claims, 5 Drawing Sheets

BUOYANCY COMPENSATOR FOR DIVERS

BACKGROUND OF THE INVENTION

This invention relates to buoyancy compensators which are used by divers employing self contained underwater breathing apparatus (SCUBA).

A buoyancy compensator is used by divers to adjust their overall specific gravity so that they are either lighter than water so that they can ascend easily, heavier than water so they can descend easily or the same as water (neutrally buoyant) so that they can easily maintain a position in water without ascending or descending.

Buoyancy compensators usually comprise a vest or jacket containing water tight and air tight compartments which can be filled with air to increase buoyancy (to decrease overall specific gravity) or from which air can be released to decrease buoyancy.

Originally such compensators were filled by orally blowing air into the compartments and air was released by opening a valve.

Subsequently such compartments were connected to an air tank (usually breathing air) through a valve such that when the valve was opened air could flow from the tank through a hose into the compensator. Usually another valve attached to the hose could be opened to release air from the compensator to the surrounding environment. In such a case the hose would usually be positioned so that the opening to the environment was closer to the surface of the water than the rest of the compensator which helped to prevent water from entering the compensator through the opening and allowed air to escape even though pressure inside the vest might be equal to exterior pressure. Buoyancy compensators employing an air chamber in the form of a compartmented vest, or otherwise are very well known and for example are described in U.S. Pat. Nos. 3,487,647; 3,727,250; 4,054,132; 4,068,657; 4,523,914; 4,529,333; 4,681,552; 4,779,554; and 4,913,589.

A problem with such known compensators has been a disadvantage in the air release mechanism. In particular the moving of a tube or hose to above the vest before air is released has been inconvenient and cumbersome.

In the event an air release valve were located near the upper shoulder area so that air could be released in most normal body positions, i.e. body horizontal to the water surface or body vertical with head up toward the water surface, opening of the valve was inconvenient due to the location of the valve and operation of such a valve was certainly not conducive to one handed operation with an air supply to the compensator.

U.S. Pat. No. 4,810,134 describes a buoyancy compensator having an air release valve in the shoulder area which is operated by pulling downward (i.e. toward the feet) on a cable secured to the valve. Such pulling is also inconvenient and may in fact distort or move the vest during operation. The cable is not connected to any type of trigger mechanism making operation of both inlet and air release (outlet) valves simple.

BRIEF DESCRIPTION OF THE INVENTION

Figure 1:
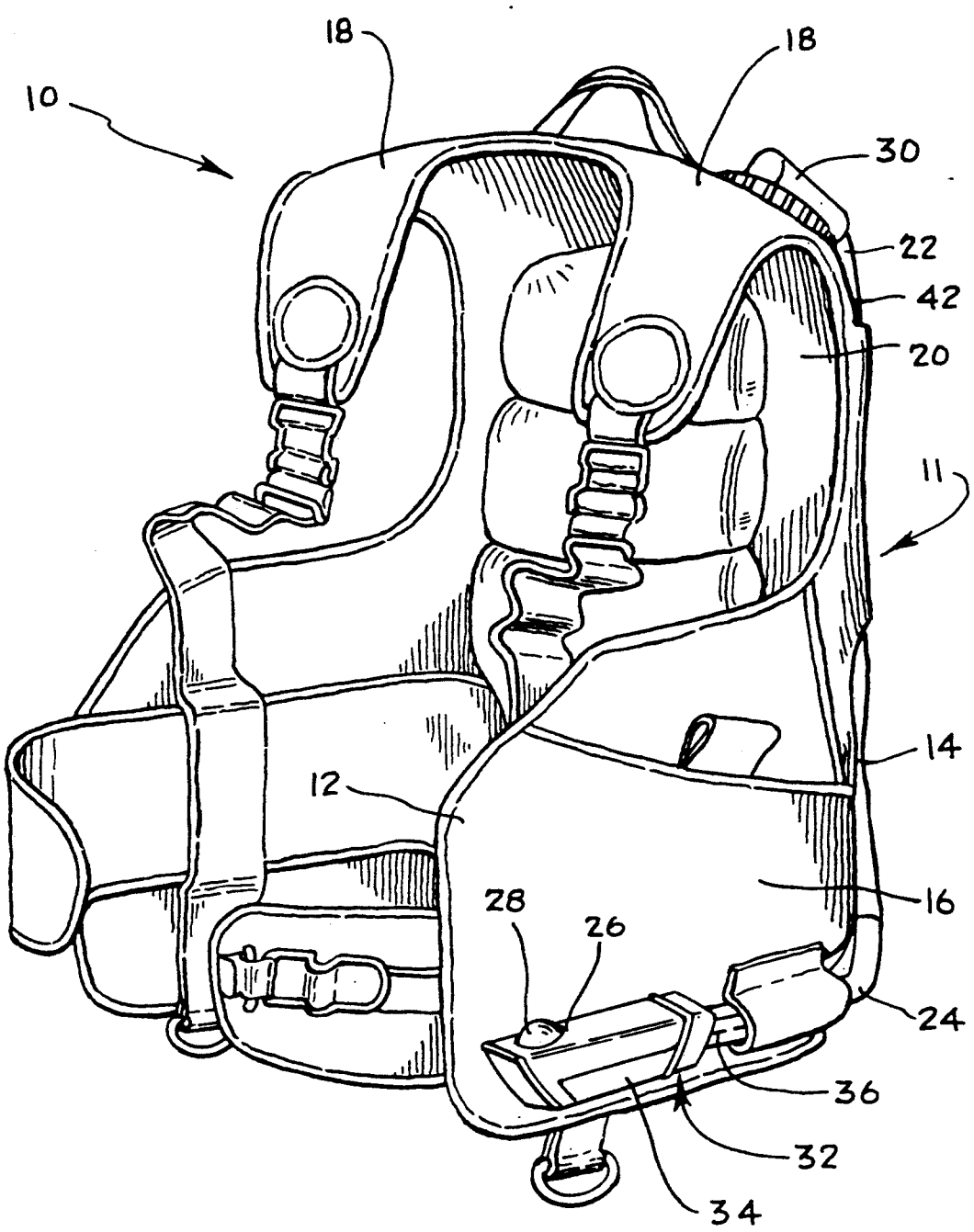
FIG. 1 is a perspective view of a preferred embodiment of a buoyancy compensator according to the invention.

In accordance with the present invention an improved buoyancy compensator for providing buoyancy to a Scuba diver is provided. The compensator comprises a vest having front, rear, side and shoulder portions which vest includes at least one compartment for holding a gas, which compartment is connected by means of an inflation tube, through a control valve and a regulating valve, to a gas supply, so that opening of the control valve allows gas to flow from the gas supply through the tube into the compartment. The compensator is further provided with a gas release valve connected to the compartment such that opening the gas release valve allows gas to leave the compartment to a surrounding environment. A trigger activated, remote control to open and close the gas release valve is provided.

DETAILED DESCRIPTION OF THE INVENTION

"Vest" as used herein means either a jacket or a vest.

"Gas" as used herein means any gas which is usually a breathing gas. Such breathing gas is usually air but may be other oxygen containing breathing mixtures, for example, wherein the quantity of oxygen is either increased or decreased relative to air or all or a portion of the nitrogen usually found in air has been substituted by oxygen or an inert gas such as helium.

"Trigger" as used herein means any mechanism which may be manually operated without significant arm motion being required from the time the mechanism is grasped until after the mechanism is activated.

The remote control comprises a trigger and a means for opening the gas release valve when the trigger is activated. Such means may for example be a cable or other linkage connected between the trigger and the gas release valve or may be a radio wave or, sonic wave or ultrasonic wave sending device activated by the trigger and a receiving sensor for sensing such a wave and signaling the electric activation of the release valve. In such a case, the wave may be coded either by being a particular frequency, being of a particular pulse pattern or both.

In accordance with the invention, the control valve and trigger are desirably positioned relative to each other so that each may be operated without repositioning the hand. It is the trigger activated remote control which makes such a convenient proximate relative positioning possible.

The air release valve itself is preferably located in a position proximate a portion of the vest which is closer to the surface of the water than most of the rest of the vest. Such a position is preferably at a position on the shoulder portion of the vest, most preferably at a position on the rear shoulder portion, since such a position is closer to the surface than a majority of the vest during normal upright vertical or horizontal swimming operations.

The buoyancy compensator preferably has a manual inflation means which includes a mouthpiece through which air may be blown, connected by means of a manual inflation tube to the compartment. The manual inflation means includes a valve which is normally closed to prevent gas from escaping from the compartment and which opens to admit air into the compartment when air is blown into the mouthpiece.

The inflation tube may comprise first and second portions wherein the first portion connects the compartment to the control valve and the second portion connects the control valve to the regulating valve. The first and second portions may be connected together along a portion of their respective lengths for neatness and convenience. Furthermore, when a cable is used between the trigger and the gas release valve, the cable may similarly be connected to the inflation tube portions for neatness and convenience. The first portion of the inflation tube and the manual inflation tube may be the same tube.

Figure 2:
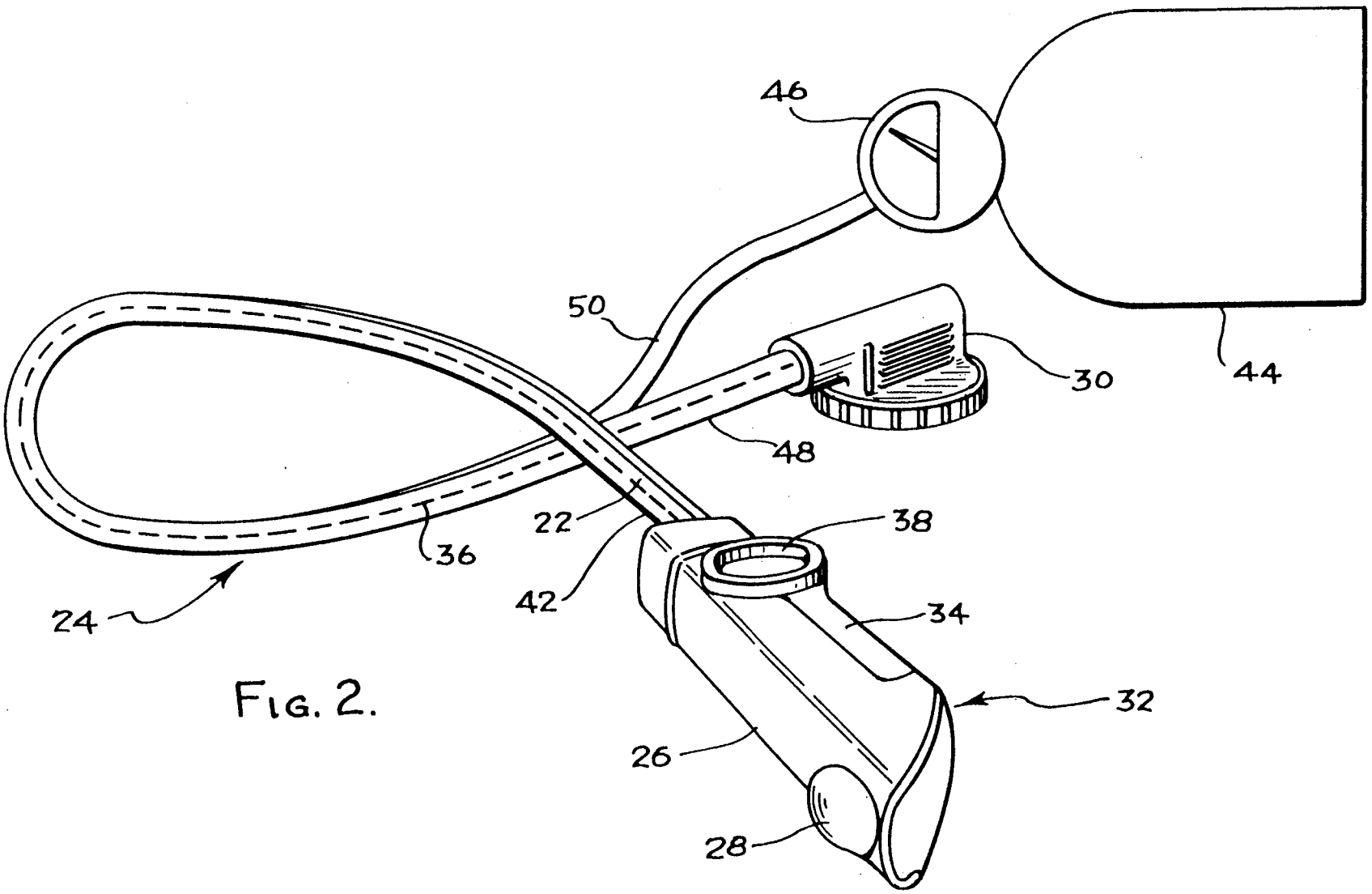
FIG. 2 is a perspective view of the automatic inflation means of the invention.
Figure 4:
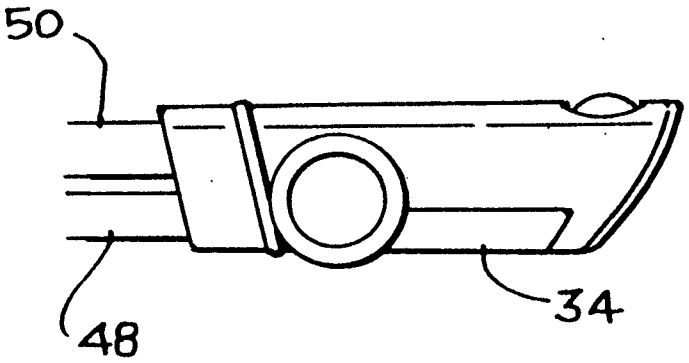
FIG. 4 is a side view of the remote control portion of the automatic inflation means shown in FIG. 2.
Figure 3:
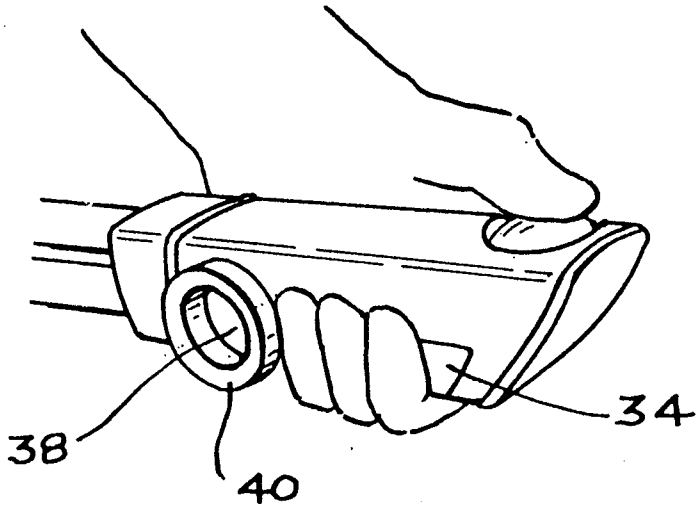
FIG. 3 is a perspective view of the remote control portion of the automatic inflation means shown in FIG. 2.
Figure 5:
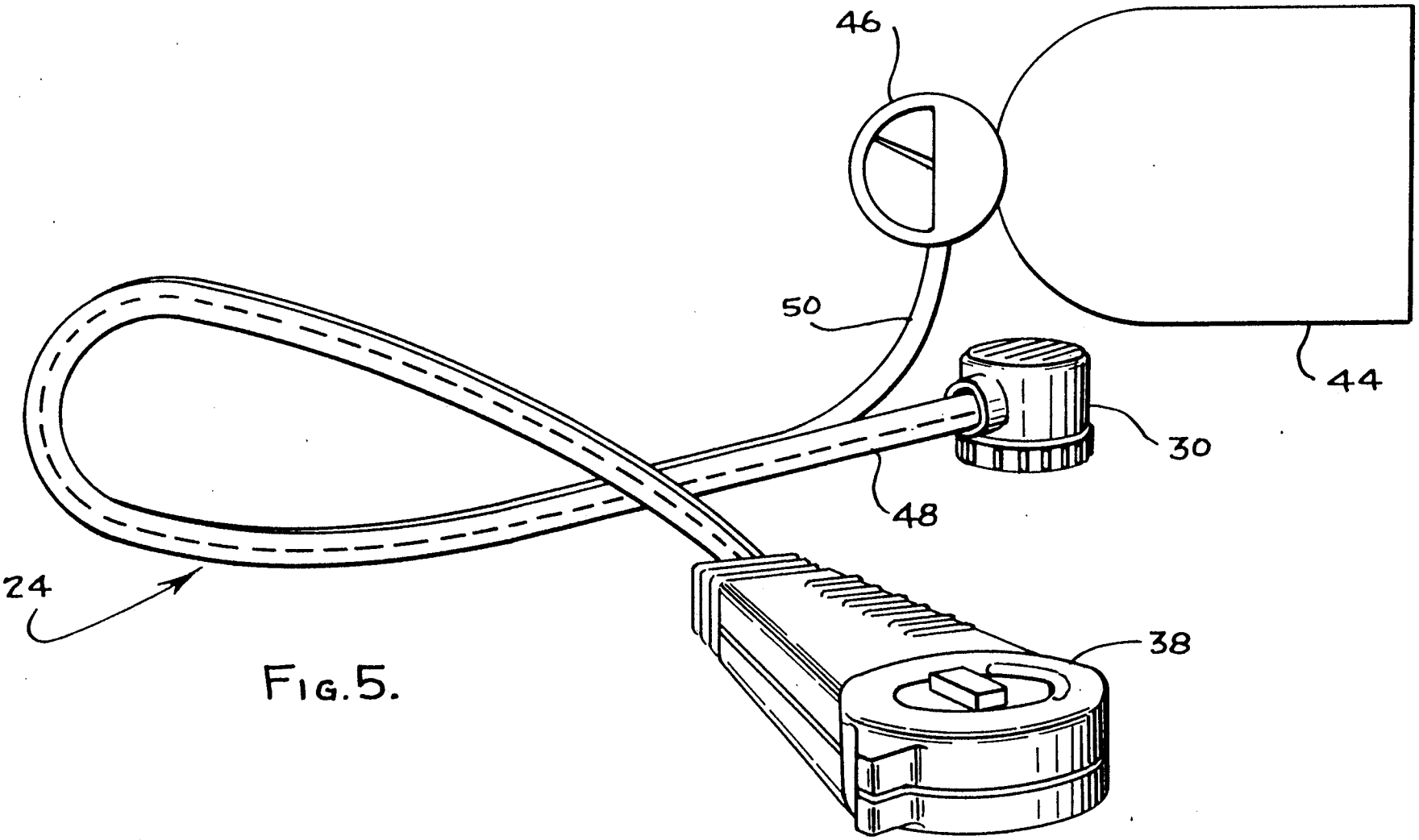
FIG. 5 is a perspective view of a second embodiment of the automatic inflation means of the invention.
Figure 7:
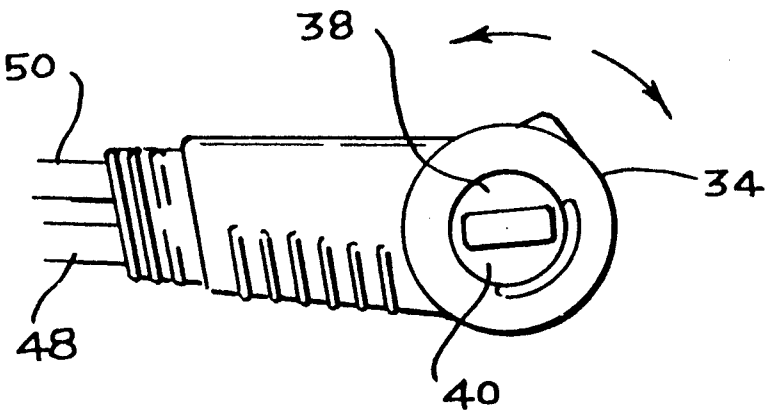
FIG. 7 is a side view of the remote control portion of the automatic inflation means shown in FIG. 5.
Figure 6:
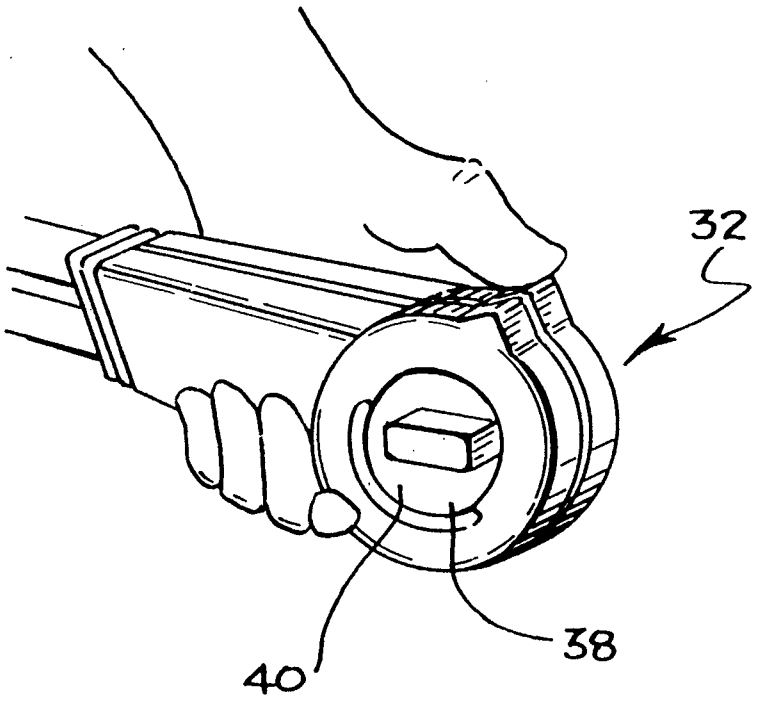
FIG. 6 is a perspective view of the remote control portion of the automatic inflation means shown in FIG. 5.

Referring to the drawings, FIG. 1 shows a perspective view of a buoyancy compensator 10 in accordance with the present invention which comprises a vest 11 having front 12, rear 14, sides 16 and shoulders 18. The vest 11 includes at least one compartment 20 for holding a gas which compartment is connected, as best seen in FIGS. 1, 2 and 5, by means of an inflation tube 22 within unitary tube and cable 24 through a control valve 26 and a regulating valve 46 to a gas supply 44 so that opening of control valve 26 by depressing button 28 forming a part thereof allows gas to flow from the gas supply 44 through the inflation tube into the compartment. The buoyancy compensator is also provided with a gas release valve 30 at a rearward position on the shoulder 18. Valve 30 is connected to compartment 20 such that opening of the air release valve 30 allows gas to leave compartment 20 to a surrounding environment. The compensator is provided with a remote control 32 provided with a trigger 34 which remotely operates gas release valve 30 by means of cable 36 connecting the trigger to the gas release valve. A manual inflation means 38 may be provided which includes a mouthpiece 40 which as shown in FIGS. 2 and 3 may form a portion of a hinge mechanism for trigger 34. Mouthpiece 40 is connected by means of a manual inflation tube 42 within unitary tube and cable 24 to compartment 20. Tubes 22 and 42 may be the same. The manual inflation means includes a valve which is normally closed to prevent gas from escaping from the compartment and which opens to admit air into the compartment. Alternatively, an oral inflation means to inflate the vest may be provided which is separate from the trigger activated remote control inflation device described herein.

In general, the inflation tube comprises first and second portions 48 and 50 within unitary tube and cable 24 wherein the first portion 48 connects compartment 20 to control valve 26 and the second portion 50 connects control valve 26 to a regulating valve 46 attached to an air supply tank 44.

What is claimed is:

1. An improved buoyancy compensator for providing buoyancy to a diver which comprises a vest having front, rear, side and shoulder portions, which vest includes at least one compartment for holding a gas, and which compensator further comprises an automatic inflation means comprising a first portion of an inflation tube connecting the compartment to a remotely activated control valve and a second portion of said inflation tube for connecting the control valve to a regulating valve attached to a gas supply, so that opening of the control valve allows gas to flow from the gas supply through the regulating valve into the second portion of the tube to the control valve and through the first portion of the tube from the control valve into the compartment; wherein the improvement comprises, said compensator being further provided with an automatic air release means, in addition to the automatic inflation means, said release means comprising a remotely activated release valve connected to said compartment such that opening the release valve allows gas to leave the compartment to a surrounding environment, at a part of the shoulder portion proximate the rear portion, and a remote control activated by a trigger to open and close the release valve by means of a cable running from the remote control, and which is free of activation by pulling on any portion of said tube, said control valve and trigger being positioned relative to each other so that they each may be operated with one hand without repositioning of the hand.

2. The buoyancy compensator of claim 1 wherein a manual inflation means is provided which includes a mouthpiece, through which air may be blown, connected by means of said first portion of said tube to the compartment, said manual inflation means including a valve which is normally closed to prevent gas from escaping from the compartment and which opens to admit air into the compartment when air is blown into the mouthpiece.

3. The buoyancy compensator of claim 1 wherein the trigger and and control valve are located in a position within easy reach of a single hand when the compensator is worn by a diver.

* * * * *